US005848497A

United States Patent [19]

Henderson

[11] Patent Number: 5,848,497

[45] Date of Patent: Dec. 15, 1998

[54] CLUSTER DESK ASSEMBLY AND COMPONENTS THEREOF

[76] Inventor: Pieter M. Henderson, 10 Beech Rd., Bedfordview, Gauteng Province, South Africa

[21] Appl. No.: 884,992

[22] Filed: Jun. 30, 1997

[30] Foreign Application Priority Data

Jul. 1, 1996 [ZA] South Africa ..... 96/5566

[51] Int. Cl.[6] ..... A47F 5/12; E04H 1/12

[52] U.S. Cl. ..... 52/36.1; 52/36.5; 108/60; 108/64; 108/50.01

[58] Field of Search ..... 108/60, 64, 50.01; 52/36.1, 36.4, 36.5

[56] References Cited

U.S. PATENT DOCUMENTS

| | | | |
|---|---|---|---|
| 3,342,147 | 9/1967 | Shettles | 108/64 |
| 3,809,142 | 5/1974 | Bleeker . | |
| 4,365,561 | 12/1982 | Tellier et al. | 108/64 X |
| 4,836,114 | 6/1989 | Cohen et al. | 108/60 X |
| 4,870,908 | 10/1989 | Wolters et al. | 108/60 |
| 4,986,194 | 1/1991 | Bollman | 108/60 |
| 5,016,405 | 5/1991 | Lee | 108/60 X |
| 5,035,186 | 7/1991 | Uredat et al. | 108/64 X |
| 5,044,135 | 9/1991 | Kroon et al. | 108/60 X |
| 5,065,832 | 11/1991 | Mark | 108/60 |
| 5,438,937 | 8/1995 | Ball et al. | 108/64 |
| 5,471,800 | 12/1995 | Hill et al. | 108/60 X |
| 5,638,758 | 6/1997 | Carr | 108/64 X |

FOREIGN PATENT DOCUMENTS

| | | |
|---|---|---|
| 2416669 | 9/1979 | France . |
| 2689380 | 10/1993 | France . |
| 2261676 | 6/1974 | Germany . |
| 4401125 | 7/1995 | Germany . |

*Primary Examiner*—Christopher Kent
*Assistant Examiner*—Yvonne Horton-Richardson
*Attorney, Agent, or Firm*—Fish & Richardson P.C.

[57] ABSTRACT

A cluster desk assembly is provided in which a desk top which is symmetrical about a center point is provided with a plurality of extension tops radiating outwardly to provide a plurality of work stations. The work stations are separated from each other by screen panels which also radiate outwardly from the center point to provide work stations, each of which includes a part of the desk top itself and at least part of one or more extension tops. The desk top may be either circular in peripheral shape or polygonal.

11 Claims, 3 Drawing Sheets

CLUSTER DESK ASSEMBLY AND COMPONENTS THEREOF

FIELD OF THE INVENTION

This invention relates to a cluster desk assembly of the general type designed to provide a plurality of work stations associated with a single office furniture assembly. More particularly, the invention relates to a cluster desk assembly in which work stations can be added or removed or adjusted in size or position as may be required in modular manner within certain practical limitations.

In this specification the term "desk" is intended to mean any article of furniture providing a horizontal work surface irrespective of the purpose to which it is put and the term "desk top" is to be interpreted accordingly.

BACKGROUND TO THE INVENTION

With ever escalating costs of business accommodation, it is becoming increasingly important to accommodate personnel working at desks or like work stations in smaller floor areas than may have been the case in the past.

On the other hand, personnel are becoming more and more demanding as regards comfort and, in many cases, privacy or at least seclusion of some type.

Furthermore, desks and other furniture providing work stations for personnel need to be economical and also flexible so that as circumstances change, so can the furniture providing the work stations be varied accordingly.

OBJECT OF THE INVENTION

It is the object of this invention to provide a cluster desk assembly, and components thereof, which satisfies the requirements outlined above, at least to substantial extent.

SUMMARY OF THE INVENTION

In accordance with this invention there is provided a desk assembly comprising a desk top supported on a suitable leg assembly and wherein the peripheral shape of the desk top is symmetrical about a center point; and at least two extension tops connected to the desk top to form a continuing surface therewith and wherein the extension tops are attachable to the desk top in a plurality of different angular positions relative to the center point and therefore relative to each other.

Further features of the invention provide for the desk top to be supported by a single leg assembly substantially co-axial with the center point and having a plurality of outwardly splayed stabilizing feet at its lower outer end; for the desk to have means for attaching a plurality of screens to a central post substantially co-axial with the center point in angular positions corresponding to those at which the extension tops extend; for a screen panel to correspond with one outwardly extending edge of an extension top or, alternatively, for a screen panel to divide an extension top into two parts, one of each is for use by a work station on each side of the screen panel; and for the peripheral shape of the desk top to be either circular or polygonal.

Still further features of the invention provide for the central leg supporting the desk top to be tubular and adapted to house any wires or cables accessing power supply or data connection points with machinery, in particular computers and the like, positioned on the desk top in which case a panel supporting post connects with the tubular leg assembly in a manner providing access apertures to the interior of the tubular leg; and for the post to be of a similar tubular construction to that of the leg to which it is releasably connected in co-axial manner.

The above and other features of the invention will become more apparent from the following description of one embodiment and various variations thereof.

Figure 1:
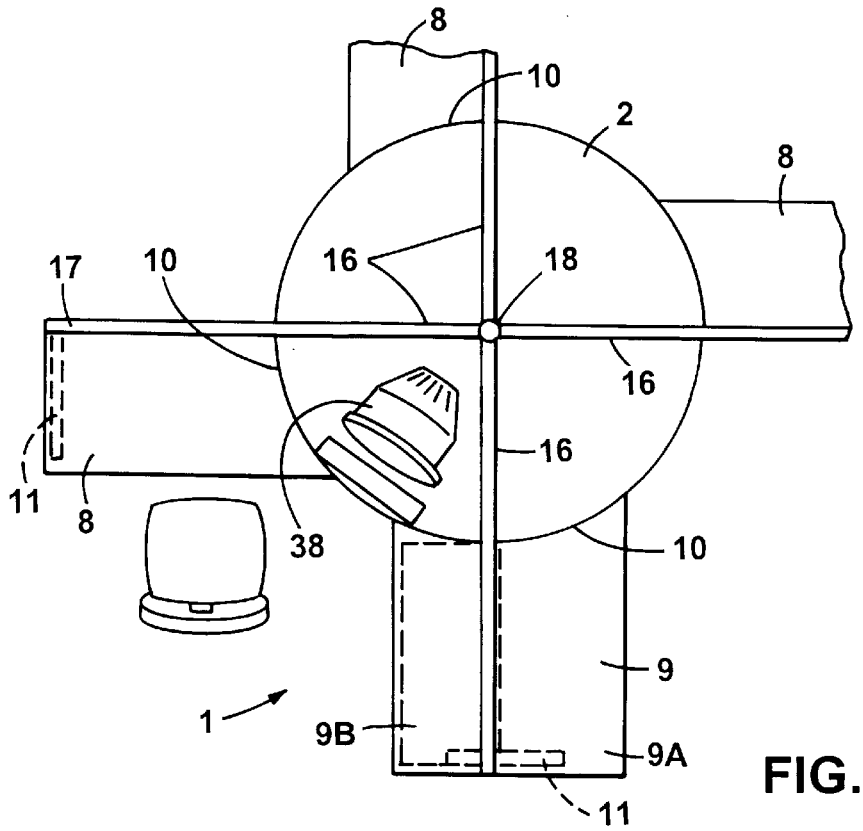
FIG. 1 is a schematic plan view of one form of cluster desk according to the invention.
Figure 2:
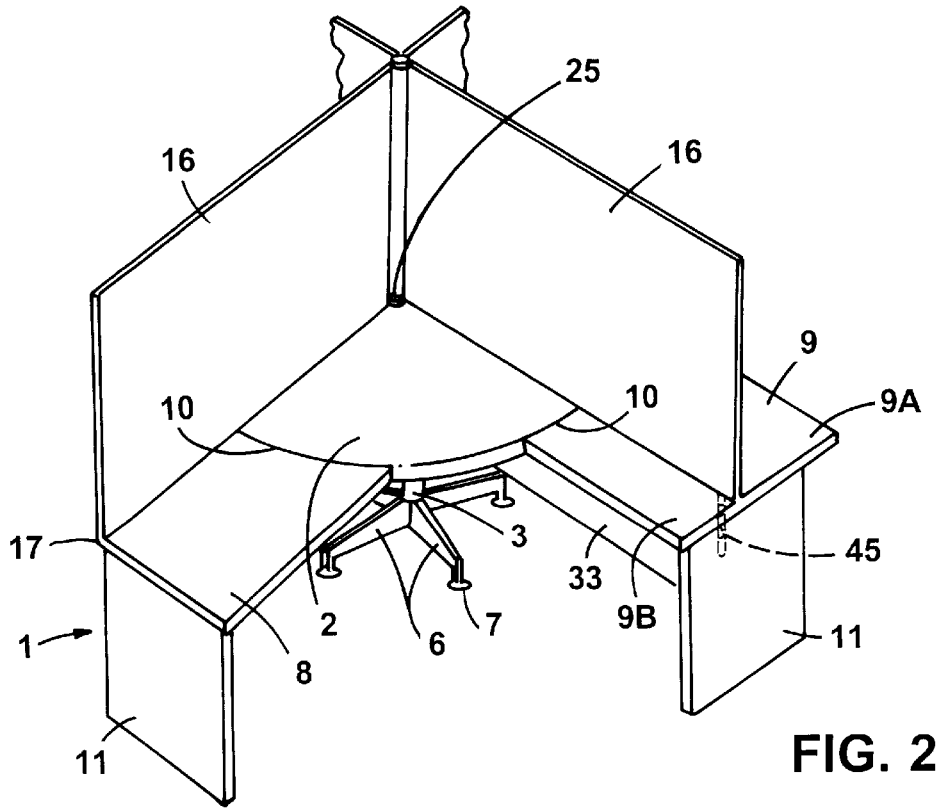
FIG. 2 is an isometric view of a part thereof.

DETAILED DESCRIPTION OF EMBODIMENTS OF THE INVENTION WITH REFERENCE TO THE DRAWINGS

In the embodiment of the invention illustrated in FIGS. 1 to 6, and more particularly in the arrangement illustrated in FIGS. 1 to 4, a cluster desk assembly generally indicated by numeral (1) has a circular desk top (2), conveniently having a diameter of the order of 1.8 m, supported on a single central tubular leg (3), the axis of which defines the center point of the desk top. The tubular leg has, towards its upper end, a large diameter circular flange (4) welded thereto (see FIG. 4) for supporting the desk top (2), and the leg extends a short distance above the upper surface of the desk top as indicated by numeral (5). The lower end of the tubular leg is provided with four equally angularly spaced outwardly extending stabilizing legs (6), each having an adjustable levelling foot (7) at its free end.

In this embodiment of the invention, extension tops (8 & 9) are of two different widths, the narrower one (8) conveniently being about 600 mm wide by about 1 m long, and the wider one (9) being 1 m wide by about 1 m long. Each has an operatively inner edge (10) cut to a recessed circular shape complimentary to the outer periphery of the circular desk top and is supported at its outer end by means of a panel-shaped leg (11). The panel-shaped leg may, of course, be replaced by a cantilever-style leg; a pedestal or drawer unit, or a credenza, as may be required.

Figure 3:
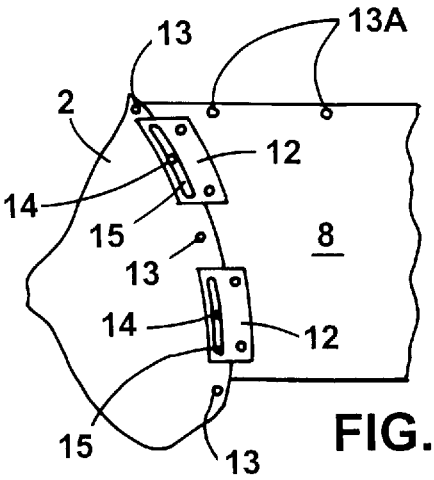
FIG. 3 is an underneath plan view showing the attachment of an extension top to the desk top.

At its inner end each of the extension tops is secured to the desk top by means of metal plates (12) fixed to the undersurface of the desk top and extension top. The plates are secured permanently to the extension tops and are securable to selected pre-drilled holes (13) provided in the undersurface of the outer region of the circular desk top with fasteners (14) passing through arcuate slots (15) in the connector plates and into the holes (13). The arrangement is such that an extension top can be connected to the circular desk top at any angular position whatsoever as the slots are dimensioned such that at least one hole (13) will be aligned with the slot at some position along its length in every such angular position. FIG. 3 shows the construction clearly.

As an alternative to the above, or in addition thereto, the extension top can be stabilized or supported at its inner end region by means of fasteners (not shown) passing through one or more holes (13*a*) in the extension top (see FIG. 3) and into the lower edge of the screen panel described below.

A vertical screen panel (16) extends from the centre point radially outwardly such that it rests on the one extreme edge (17) of the extension tops in the case of the narrower tops (8), and rests on the wider top in a manner so as to divide it into two portions, one (9*a*) having a width of about 600 mm and one (9*b*) having a width of somewhat less than 400 mm. As shown most clearly in FIG. 1, where four screen panels are present, the arrangement provides additional work space (9*b*) for a person using a work station having access to both the panel (9*b*) and an extension top (8).

The screen panels are held in position at one end by means of a central post (18) which is supported by the upper end region of the leg (3) of the desk top. At the other end, the screen panels have a spigot (45, FIG. 2) extending downwardly through the extension top into a socket in the leg assembly.

Figure 4:
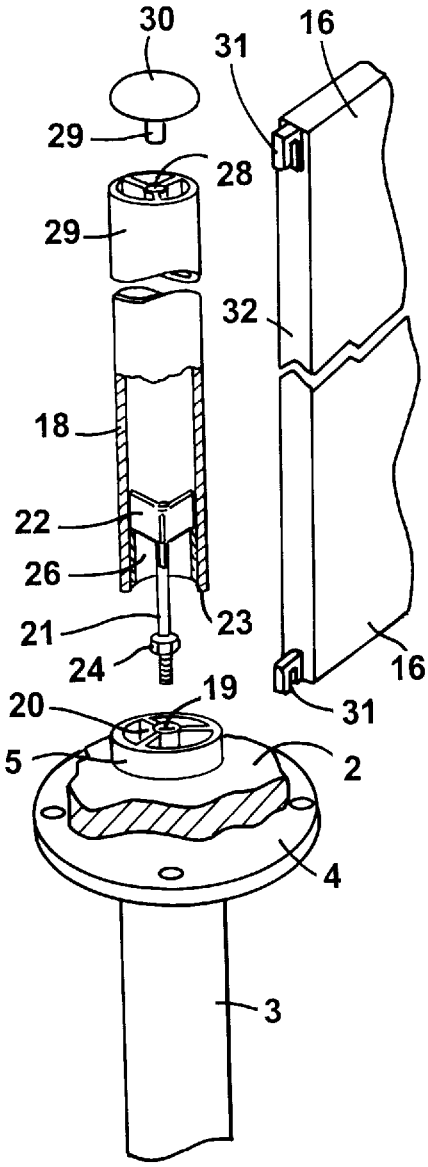
FIG. 4 is a partly broken away, exploded view of the upper end of the desk leg and associated screen supporting post.

Referring now more particularly to FIG. 4, the post (18) is tubular and of the same diameter as the leg. In order to connect the two co-axially, the leg has a screw threaded socket (19) supported axially therein by means of welded fins (20) which are positioned to enable wires and cables to pass therethrough. A screw threaded shank (21) co-operates with the socket, the shank similarly being secured by means of fins (22) to the inside of the post. The latter fins are spaced inwardly from the free end (23) of the post and a nut (24) is fixed to the shank to enable it to be tightened.

The nut (24) also has an additional purpose of forming a stop so that a gap (25) (see FIG. 2) is formed between the upper end of the tubular leg and the lower end of the post when the latter is fully installed in position. This gap enables power leads and electronic cables to pass out of the tubular leg in which they can be housed and to be connected to the machinery with which they operate. An axially slidable plastic sleeve or skirt (26) is positioned inside the lower end of the post so that this can drop down to cover the gap to any extent that is possible or completely if no cables communicate between the tube and desk top. The lower edge may have a series of removable portions to enable an aperture to be formed appropriate to the cables or wires passing it.

The upper end (27) of the post has a socket (28) therein similarly located to the socket (19) in the leg and a screw threaded stud (29) having a decorative head (30) is provided for finishing off the upper end of the post.

A screen panel (16) is supported on the post by means of a pair of hook-shaped fittings (31) secured to the vertical inner edge (32) of the screen panel such that the hook-shaped fittings (31) hook over the upper edge of the post and upper edge of the leg respectively and can be clamped in this position by means of the decoratively headed stud (29). If required, a post may also be provided with additional support positions up its height which are analogous to that attaching the post to the leg. These would be used to support screen panels of different heights radiating from the post in the same way as is described above.

For use, the post is secured to the leg by means of the screw threaded shank (21); all of the screen panels are hooked in position; and, the decoratively headed screw (29) tightened in position to lock the whole assembly together. The panels can, in addition, be secured to the individual extension tops from the underneath thereof as well as by means of the spigot and sockets mentioned above, as well as the fasteners passing through the holes (13*a*) in the extension tops. Modesty panels (33) (see FIG. 2) can also be provided as and where required.

Figure 5:
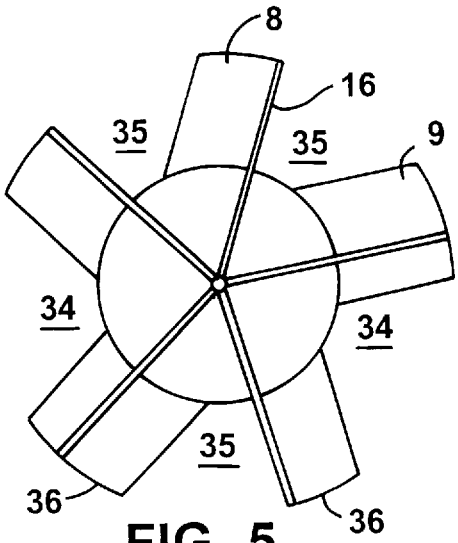
FIGS. 5 & 6 are each plan views showing different arrangements of extension tops and screens relative to the circular desk top.

It will be understood that the arrangement described above enables a wide variety of different arrangements to be made with various different extension tops and numbers thereof. Thus, as shown in FIG. 5, an arrangement can be made whereby two work stations having double work tops indicated by numeral (34) and three smaller work stations (35) having a single work top and all of which are divided by screen panels (16) can easily be made. FIG. 5 also illustrates a modification in that the outer edges (36) of the extension tops are all made to conform to a circular outer shape to avoid corners presenting a problem.

Figure 6:
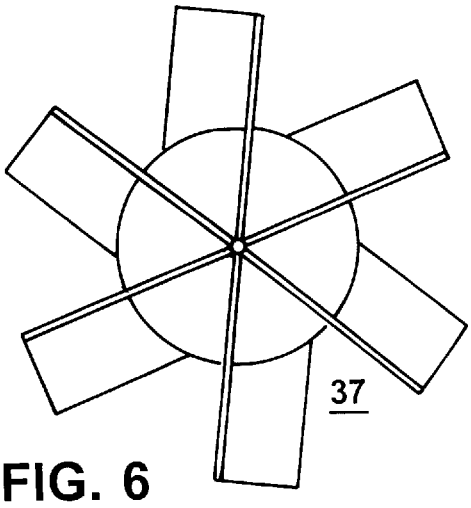

FIG. 6 illustrates an arrangement in which six work stations (37) are provided with single work tops.

Thus, it will be appreciated that a wide variety of different arrangements of work stations can be achieved using the desk and a variety of extension tops and screen panels can be made in modular manner and can be changed as and when required. The concept of providing an inner corner to each work station enables space which is usually lost to be occupied by a computer monitor (38), for example, as shown in FIG. 1. In this manner space is optimised to a substantial extent.

Figure 7:
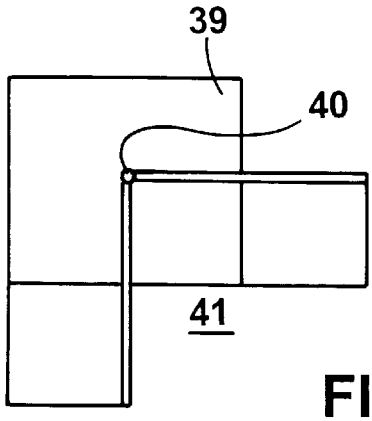
FIGS. 7 & 8 illustrate schematically in plan view two alternative shapes of desk tops for cluster desks according to the invention.
Figure 8:
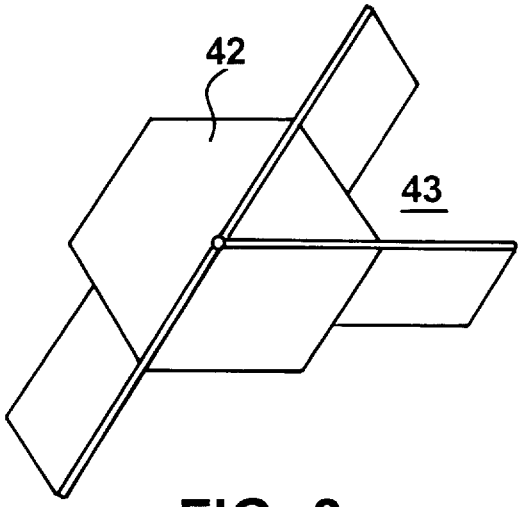

It will be understood that the invention is not limited in application to desk tops of circular shape, but could be applied to various polygonal shapes as well. Thus, as shown in FIG. 7, a square desk top (39) having a center point (40) could be used to provide anything from one to four work stations (41), although the arrangement does not have anything like the flexibility of the embodiment described above. Similarly, as shown in FIG. 8, an hexagonal desk top (42) could be used to provide anything from one to six work stations (43).

It will therefore be appreciated that the invention provides an extremely useful and highly effective cluster desk assembly which can be employed to utilize floor space in a highly effective and efficient manner.

What I claim as new and desire to secure by Letters Patent is:

1. A desk assembly comprising a desk top supported on a suitable leg assembly and defining a desk top surface, and wherein the peripheral shape of the desk top is symmetrical about a center point; and at least two extension tops connected to the desk top to form a continuing surface with said desk top surface and wherein the extension tops are attachable to the desk top in a plurality of different angular positions relative to the center point and therefore relative to each other.

2. A desk assembly as claimed in claim 1 in which the desk top is supported by a single leg assembly substantially co-axial with the center point.

3. A desk assembly as claimed in claim 2 in which the leg assembly has a plurality of outwardly splayed stabilizing feet at its lower end.

4. A desk assembly as claimed in claim 1 in which means are provided for supporting a plurality of screens radiating from substantially the center point in angular positions corresponding to those at which the extension tops extend.

5. A desk assembly as claimed in claim 4 in which the means supporting a plurality of screens includes a central post.

6. A desk assembly as claimed in claim 4 in which a screen panel corresponds substantially with one edge of the associated extension top so as to provide part of a work station on one side of the screen.

7. A desk assembly as claimed in claim 4 in which a screen panel divides an extension top into two parts to provide a part of each of two different work stations, one on each side of the screen panel.

8. A desk assembly as claimed in claim 4 in which the means for supporting a plurality of screens radiating from substantially the center point is adapted to enable screens of different heights to be simultaneously supported in such positions.

9. A desk assembly as claimed in claim 1 in which the desk top has a circular peripheral shape and the adjacent edge of each extension top is shaped accordingly.

10. A desk assembly as claimed in claim 1 in which the desk top has a polygonal peripheral shape wherein the number of straight edges defines the maximum number of possible work stations.

11. A desk assembly as claimed in claim 1 in which the leg assembly is adapted to house and obscure wires and cables communicating between the desk top and any power supplies or data connection points.

* * * * *